US007661248B2

(12) United States Patent
Conti

(10) Patent No.: US 7,661,248 B2
(45) Date of Patent: Feb. 16, 2010

(54) DEVICE FOR DOSING AND FORMING DISKS FOR PODS CONTAINING A PRODUCT FOR INFUSION

(75) Inventor: Roberto Conti, Imola (IT)

(73) Assignee: I.M.A. Industria Macchine Automatiche S.p.A., Ozzano Emilia (Bologna) (IT)

( * ) Notice: Subject to any disclaimer, the term of this patent is extended or adjusted under 35 U.S.C. 154(b) by 288 days.

(21) Appl. No.: 10/566,475

(22) PCT Filed: Jul. 23, 2004

(86) PCT No.: PCT/IB2004/002503

§ 371 (c)(1),
(2), (4) Date: Jan. 31, 2006

(87) PCT Pub. No.: WO2005/012100

PCT Pub. Date: Feb. 10, 2005

(65) Prior Publication Data

US 2006/0207619 A1 Sep. 21, 2006

(30) Foreign Application Priority Data

Aug. 1, 2003 (IT) ..... BO2003A0475

(51) Int. Cl.
*B65B 13/20* (2006.01)
*B65B 63/02* (2006.01)
*G01F 11/06* (2006.01)

(52) U.S. Cl. ..... 53/529; 53/113; 53/438; 222/218

(58) Field of Classification Search ..... 53/122, 53/113, 523, 528, 529, 559, 428, 436, 438, 53/439; 222/216, 217, 218, 219, 225
See application file for complete search history.

(56) References Cited

U.S. PATENT DOCUMENTS

| | | | | |
|---|---|---|---|---|
| 1,524,915 | A * | 2/1925 | Debay | 425/220 |
| 2,653,430 | A * | 9/1953 | Vogt | 53/464 |
| 2,684,186 | A * | 7/1954 | Mattos | 222/218 |
| 3,218,776 | A * | 11/1965 | Cloud | 53/453 |
| 3,418,140 | A * | 12/1968 | Fisher | 426/394 |
| 3,578,217 | A * | 5/1971 | Miller | 222/218 |
| 4,437,294 | A * | 3/1984 | Romagnoli | 53/553 |
| 4,747,250 | A * | 5/1988 | Rossi | 53/511 |
| 4,870,808 | A * | 10/1989 | Romagnoli | 53/529 |
| 6,135,120 | A | 10/2000 | Löfman et al. | |
| 6,799,409 | B2 * | 10/2004 | Altvater et al. | 53/122 |

FOREIGN PATENT DOCUMENTS

| | | |
|---|---|---|
| DE | 199 20 835 A1 | 11/2000 |
| EP | 0 432 126 A1 | 6/1991 |

* cited by examiner

*Primary Examiner*—Paul R Durand
(74) *Attorney, Agent, or Firm*—Arent Fox LLP

(57) ABSTRACT

A device for dosing and forming pods (1) containing a product for infusion and comprising a piece of filter material containing a dose of the product for infusion. The device comprises: a station (2) for feeding the product into at least one forming impression (3) defining a single dose of the product and made in means (4) for forming a respective compressed disk (5) of the infusion product and releasing the compressed disk (5) from the impression (3) in the filter material to form the pod (1).

11 Claims, 3 Drawing Sheets

DEVICE FOR DOSING AND FORMING DISKS FOR PODS CONTAINING A PRODUCT FOR INFUSION

CROSS-REFERENCE TO RELATED APPLICATION

This application is a National Stage entry of International Application Number PCT/IB2004/002503, filed Jul. 23, 2004. The disclosure of the prior application is hereby incorporated herein in its entirety by reference.

TECHNICAL FIELD

The present invention relates to a device for dosing and forming disks for pods for products for infusion.

BACKGROUND ART

In the current market of products for infusion, such as coffee, barley coffee, tea and camomile, the use of single-dose "pods" has increased considerably and a very popular way of making American-style coffee is now to use such pods in specially designed machines, even for household or office use (that is, for small to medium quantities).

This specification does not concern other forms of filter bags normally used to make American-style coffee and consisting of a "maxi dose" bag designed to be placed in a funnel-like container at the top of a machine that supplies boiling hot water. The hot water comes into contact with the coffee filter bag producing a brew of coffee which is simply allowed to drip into a cup below.

Unlike this type of solution—which is widely used and extremely popular—pods used to brew a single serving of beverage usually consist of two portions of filter paper placed one over the other and sealed to enclose a single product dose of circular shape.

In the specific case of pods for American-style coffee, the product is not (and must not be) excessively compressed, which means that it remains relatively loose inside the pod.

For technical reasons linked to the type of machines used to make them, the pods have an asymmetrical profile, that is to say, with one flat surface (defined by one of the portions of filter paper) and one cupped surface (defined by the other portion of filter paper) containing the dose of infusion product.

One prior art method and related apparatus for making this type of pod is described in patent EP-432.126. The method disclosed therein comprises the following sequence of steps:

- feeding a first web of filter paper to a station where suitable means cause the filter paper to be wrinkled or crinkled;
- moving the web of filter paper along the surface of a forming drum, provided with circular pockets and with suction means, and simultaneously training a belt in contact with the filter paper, with the filter paper being between the belt and the surface of the forming drum, so that spaced areas of the belt are pulled by suction into the pockets in the drum, drawing the filter paper along with it in such a way as to form a succession of pouches in the filter paper;
- filling a dose of product into each pouch by means of a dosing station located downstream of the suction drawing belt in the direction of rotation of the pouch forming drum and consisting of a second revolving drum synchronised with the pouch forming drum;
- joining the first web of filter paper, provided with the product filled pouches, to a second web fed at a respective sealing station located downstream of the filling station, again relative to the direction of rotation of the forming drum;
- cutting out the pods thus made and feeding them out towards further packaging stations.

The structure of the dosing and forming unit of the apparatus has several disadvantages due to:

- the need to pre-process the web of filter paper to make it suitable for forming the pouches, which means that the apparatus requires an additional station; this operation being necessary especially when two or more parallel rows of pouches are formed in the filter paper web; and
- the possible difficulty of accurately controlling the volume of product filled into each pouch on account of the two revolving cylindrical surfaces of the drums (dosing and forming); this can cause a certain amount of product being lost as it is gravity fed into the pouch.

The aim of the present invention is to overcome the above mentioned drawbacks by providing a device with a simple structure for dosing and forming disks for pods containing products for infusion and that allows the disk of infusion product to be formed in a manner that is at once practical, fast and reliable in dosing the product, and enables the product disk to be placed on a web of filter paper at high operating speeds.

DISCLOSURE OF THE INVENTION

According to the invention, this aim is achieved through a device for dosing and forming disks for pods containing a product for infusion and comprising a piece of filter material containing a dose of the product for infusion. The device comprises: a station for feeding the product into at least one forming impression defining a single dose of the product and made in means for forming a respective compressed disk of the infusion product and releasing the compressed disk from the impression in the filter material to form the pod.

BRIEF DESCRIPTION OF THE DRAWINGS

The technical characteristics of the invention, with reference to the above aims, are clearly described in the claims below and its advantages are apparent from the detailed description which follows, with reference to the accompanying drawings which illustrate preferred embodiments of the invention provided merely by way of example without restricting the scope of the inventive concept, and in which:

DETAILED DESCRIPTION OF THE PREFERRED EMBODIMENTS OF THE INVENTION

Figure 1:
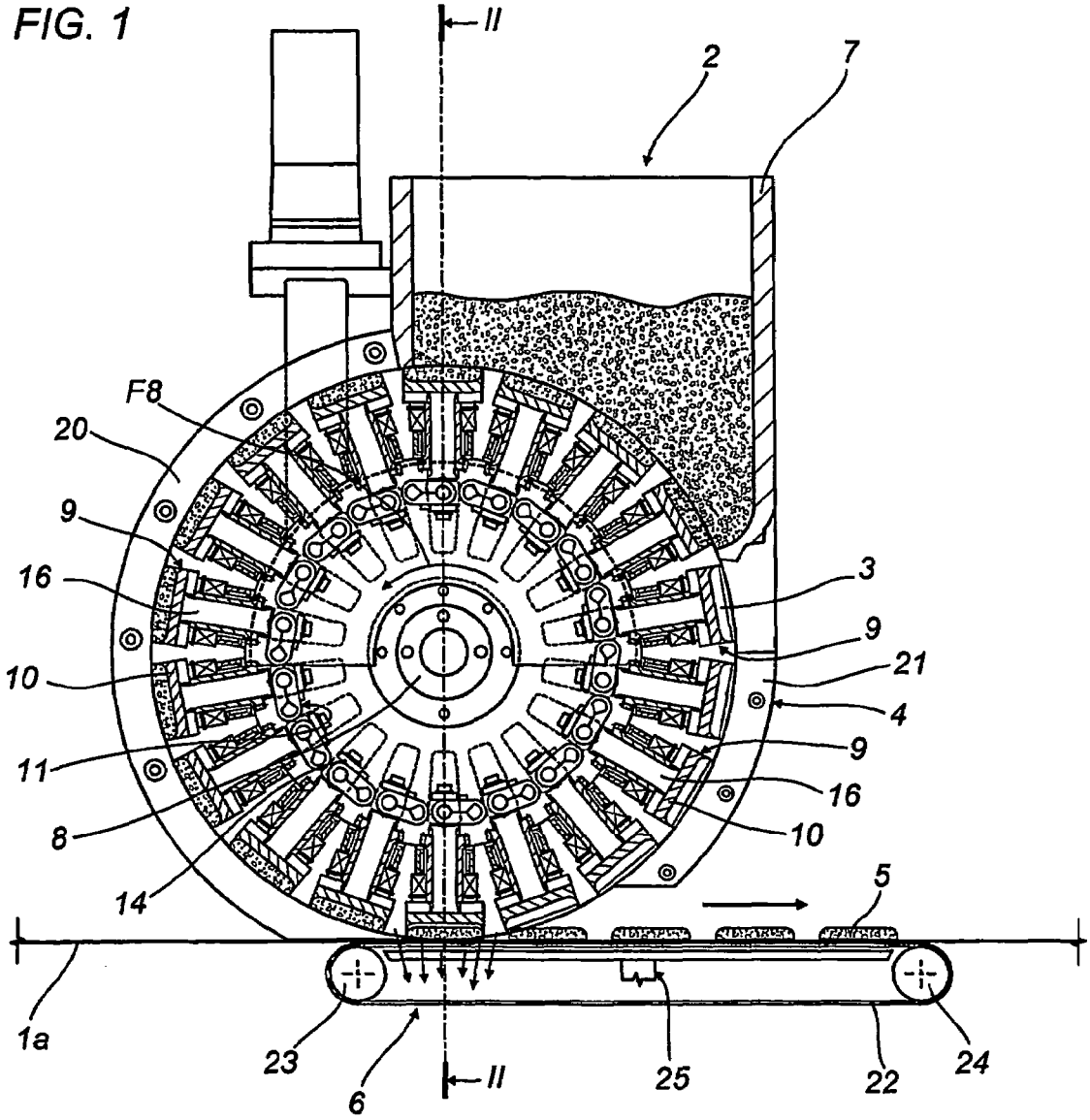
FIG. 1 is a side view, with some parts cut away and others in cross section in order to better illustrate certain details, of a device for dosing and forming disks for pods containing products for infusion.
Figure 4:
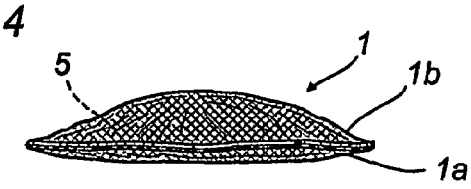
FIG. 4 is a schematic side view of a pod for products for infusion made using the device illustrated in the drawings listed above.

With reference to the accompanying drawings, in particular FIGS. 1 and 4, the device according to the invention may be used to make disks for pods 1, usually single-dose pods, of filter material containing a product for infusion, such as but not restricted to, an American blend of ground coffee, barley coffee, etc.

The present specification describes only the station for feeding the infusion product and forming a product disk 5, without regard to other stations upstream or downstream of the device according to the invention in a generic apparatus for making the pod as a whole.

The pod 1 illustrated in FIG. 4 is just an example of the type of pod referred to, without restricting the scope of the invention: the pod 1 consists of a dose of the product enclosed between two lengths 1*a* and 1*b* of filter mterial placed one over the other and sealed round the edges.

The device according to the invention (see FIGS. 1 to 3) basically comprises a station 2 for feeding the product into at least one forming impression 3 defining a single dose of the product and made in means 4 for forming a respective compressed disk 5 of the infusion product and releasing the compressed disk 5 from the impression 3 onto the filter material to form the pod 1.

The impression 3 performs these operations as it travels round a circular path P around which the means 4 move.

The dosing station 2 comprises a fixed hopper 7 mounted to face a revolving drum 8 (see arrow F8) forming part of the forming means 4.

The hopper 7 has an arc-shaped discharge portion to peripherally follow a passing surface of the drum 8 in such manner that the product is dosed in a predetermined area.

Figure 2:
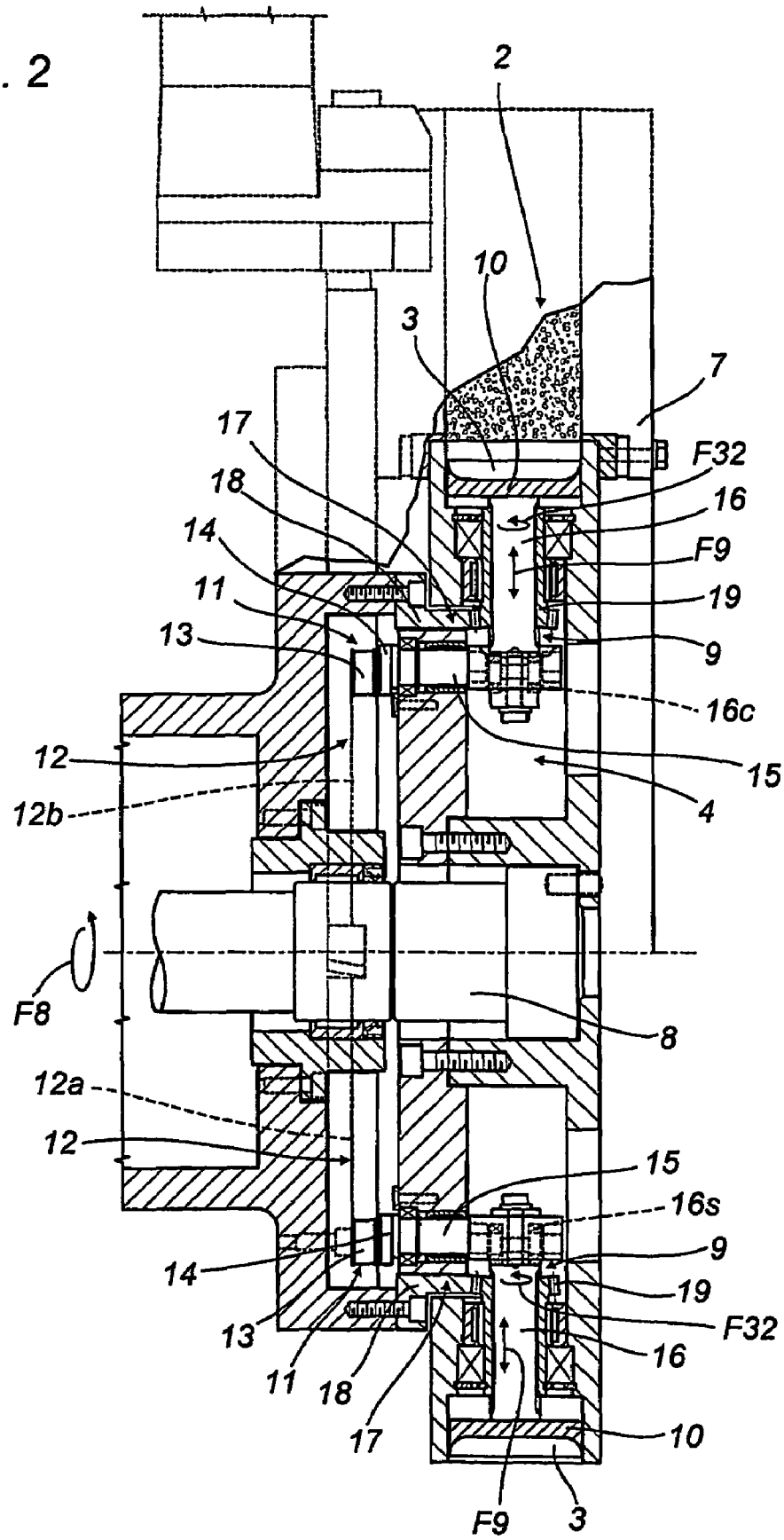
FIG. 2 is a cross-section through line II-II of FIG. 1.

FIGS. 1 and 2 show that the revolving drum 8 is equipped with a plurality of pistons 9 arranged radially on the surface of the drum 8, each piston 9 having a hollow head 10 defining the impression 3 for receiving a dose of the product fed by the hopper 7.

As described in more detail below, each of the pistons 9 can perform a series of synchronised movements in a radial direction, thanks to drive means 11, while also rotating continuously about its axis in such a way as to allow the disk 5 to be properly formed as described above and at the same time keeping the disk 5 compressed and detached from the walls of the hollow head 10 defining the impression 3.

To do this, the aforementioned radial drive means 11 are fitted between each piston 9 and the drum 8 to act upon the pistons 9 in such manner as to impart the plurality of synchronised movements to the pistons 9 according to their angular positions on a circular path, labelled P, and so as to:

receive the product;

compress the product to form the disk 5; and detach and deposit the disk 5 onto the filter material.

Looking in more detail, the radial drive means comprise cam means 11 consisting of at least one guide cam profile 12 stably associated with the interior of the drum 8 and engaged by a cam follower roller 13 for each piston 9.

Each cam follower roller 13 is rigidly attached to the end of a respective connecting rod 14 whose other end is associated with a control pin 15 rotatably connected to the inside end of the cylinder 16 of the piston 9 so as to drive the piston 9 radially in both directions according to the angular position of the piston 9 on the circular path P.

In other terms, the control pin 15 is in rotatable contact, through a bearing 16*c*, with the base of the cylinder 16 so as to drive the piston 9 backwards and forwards (see arrows F9) according to the movements of the cam follower roller 13.

Figure 3:
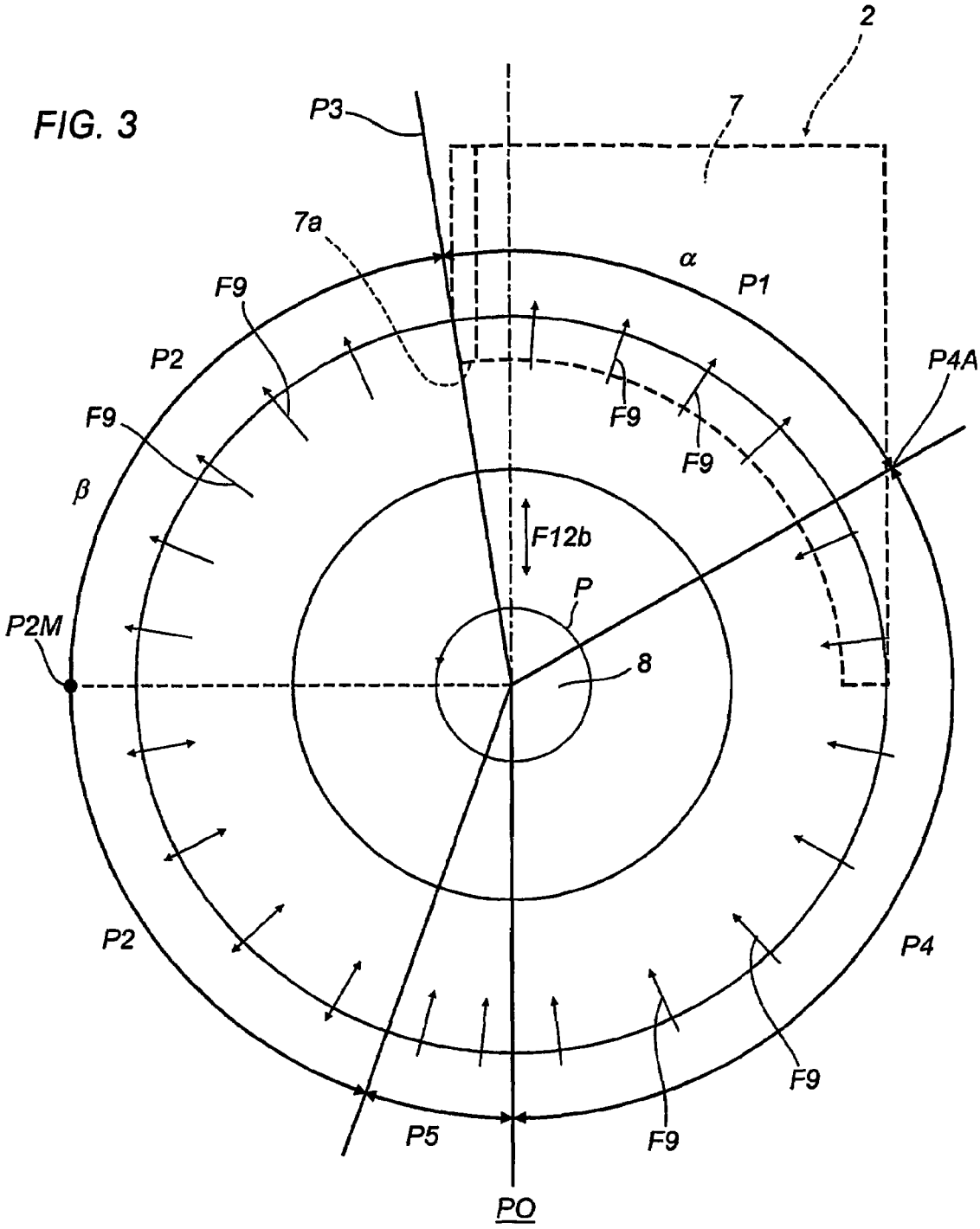
FIG. 3 is a side view illustrating the motion of the forming means of FIG. 1.

The movements of the pistons 9 are indicated in the diagram of FIG. 3. As shown, each piston 9 starts at an imaginary zero point P0 and performs the following movements along circular arcs:

in a first section P4 the piston 9 is moved radially towards the inside of the drum 8 to a product dosing position, that is to say, in such a way that the head 10 is moved away from the arc-shaped section of the hopper 7 and the piston 9 reaches a point P4A corresponding to its bottom dead centre;

in the dosing path labelled P1 (through an angle $\alpha$), the piston 9 is initially away from the arc-shaped section of the hopper 7, so as to collect as much product as possible in the head 10, and then starts moving a little in a radial direction towards the outside of the drum 8 until it reaches the endpoint P3 of the hopper 7 where there is a wall 7*a* for levelling off the product accommodated in the impression 3;

during feed along the path labelled P2 (through an angle $\beta$) for tamping the disk 5, the piston 9 continues moving radially towards the outside of the drum 8 and against a stop wall 20 until it reaches its top dead centre, corresponding to the point P2M, where it remains until it starts on a path section P5;

thus, just before returning to the zero point P0 where the disk 5 is released, the piston 9 starts moving back up along the arc-shaped path section P5 in order to facilitate detachment of the disc 5 from the impression 3.

To enable these movements to be performed precisely, the cam profile 12 is divided into two arc-shaped sections 12*a*, 12*b*, a fixed lower section 12*a* and an adjustable upper section 12*b* corresponding to the part of the path P of the pistons 9 comprising at least the dosing path P1: this makes it possible to accurately gauge the positions between the impression 3 and the hopper 7 so as to control the volume of product that goes into the impression 3.

More specifically, the half arc defining the section 12*b* can be adjusted, in both directions, as indicated by the arrow F12*b*, so as to increase or decrease the distance between the piston 9 head 10 and the levelling off point P3 corresponding to the volume of product inside the head 10 but without changing the endpoints of the half arc 12*b*.

As mentioned above, the pistons 9 can rotate continuously about their axes (see arrow F32 in FIG. 2) thanks to rotational drive means 17 located on the drum 8 and acting on each piston 9.

The rotational drive means 17 may comprise a fixed ring gear 18 mounted inside the drum 8 and meshed with corresponding gear wheels 19 keyed to the respective cylinder 16 of each piston 9 so that the pistons 9 revolve continuously as they move round the circular path P.

This rotation has the effect of tamping the disk 5 but without allowing the surface of the product to adhere to the surface of the head 10 of the piston 25 within the impression 3: this means that when the disk 5 is subsequently released onto the filter material, the disk 5 is detached fully and cleanly.

As mentioned above, there are arc-shaped walls 20 and 21 round the outer surface of the drum B designed to permit the pistons 25 to be pushed against the impressions 3 of the pistons 9 in a part of the circular path P and in such a way as to co-operate with the pistons 9 at least when the disk 5 is formed and compressed.

As illustrated in FIG. 1, under the drum 8 there may be a station 6 for feeding the filter material 1*a* that receives the disk 5 from the drum 8.

This feed station 6 may comprise an endless belt 22, trained around a pair of power driven sheaves 23 and 24.

The surface of the belt 22 is preferably perforated or porous so as to enable means 25 for creating a vacuum to interact with the working section of the belt 22: this is the belt section that feeds the web of filter material 1*a* and is where the product disk 5 is deposited and held by suction correctly in place on the web of filter material web 1*a* (the means 25 are illustrated schematically since they are of known type).

This specification refers, purely by of non-restricting example, to the placing of the disk 5 on a web 1*a* of filter material, assuming that downstream of the device according to the invention there are further stations for completing the pod 1 in its final form as illustrated in FIG. 4: that is to say, consisting of two pieces of filter material 1*a* and 1*b* enclosing the disk 5 and sealed to each other.

The device as described above permits single-dose disks 5 for pods containing an infusion product to be formed cleanly and extremely rapidly with precisely measured doses of product.

The special structure of this dosing and forming unit makes it possible to achieve high production speeds even using single rows of filter material, thus making the design of the remaining apparatus simpler and more flexible.

The device creates an extremely compact and clean disk of precisely dosed product thanks to the simultaneous translational and rotational movements of the forming pistons: the translational movement controls the steps of dosing, forming and releasing the product disk, whilst the rotational movement enables the disk to be tamped quickly and in a short path length and without allowing it to adhere to the surface of the impression.

The invention described has evident industrial applications and may be subject to modifications and variations without thereby departing from the scope of the inventive concept. Moreover, all the details of the invention may be substituted by technically equivalent elements.

The invention claimed is:

1. A device for dosing and forming disks for pods containing a product for infusion; the pods being of the type comprising a piece of filter material containing a dose of the product for infusion in the form of a disk, wherein the device comprises at least the following:

a station for feeding the infusion product;

a revolving drum equipped with a plurality of pistons arranged radially on a peripheral surface of the revolving drum and designed to form a disk of the infusion product and to release the disk in the filter material, each piston being able to slide along a respective axis and having a hollow head forming an impression designed to receive a dose of the infusion product fed by the feed station, the impression being moved by the revolving drum along a circular path; and a rotational drive means acting directly on each piston and designed to continuously revolve each piston about its axis due to revolution of the drum;

wherein the rotational drive means comprises a fixed ring gear mounted inside the revolving drum and meshed with corresponding gear wheels keyed to the respective cylinder of each piston so that the pistons revolve continuously as the gear wheels engage the fixed ring gear while the pistons move round the circular path, thus tamping the disk and preventing it from sticking inside the head of the piston while enabling the disk to be detached completely when it is deposited on the filter material.

2. The device according to claim 1, wherein, under the revolving drum, there is a station for supporting and feeding the filter material.

3. The device according to claim 2, characterised in that the feed station comprises a first belt, trained around a pair of sheaves and having a perforated or porous surface; the device further comprising means for creating a vacuum at least at a working section of the first belt on which the product disk is deposited.

4. The device according to claim 1, wherein the feed station comprises a fixed hopper mounted to face the revolving drum and presenting an arc-shaped discharge portion which peripherally follows a passing surface of the revolving drum in such manner as to permit feeding of the product in a predetermined area.

5. The device according to claim 1, further comprising radial drive means acting between each piston and the revolving drum for imparting a plurality of synchronised movements to the pistons according to their angular positions on said circular path and so as to receive the product, compress the product to form the disk, detach and deposit the disk onto the filter material.

6. The device according to claim 5, wherein there are arc-shaped walls round the outer surface of the revolving drum, said arc-shaped walls defining a surface opposite to the impression of the pistons in a part of the circular path in such a way as to co-operate with the pistons at least when the disk is formed and compressed.

7. The device according to claim 5, wherein the radial drive means comprise cam means having at least one guide cam profile stably associated with the interior of the revolving drum and engaged by a cam follower roller for each piston; each cam follower roller being attached to the end of a respective connecting rod whose other end is associated with a control pin rotatably connected to the inside end of a cylindrical portion of the piston so as to drive the piston radially in both directions according to the angular position of the piston on the circular path.

8. The device according to claim 7, wherein said circular path is divided into angular sections, each single piston being movable between different positions which are determined by the cam means according to the angular section of the circular path and corresponding to:

a first arc-shaped path section where the piston is radially retracted towards the revolving drum in such a way that the piston moves into a product dosing configuration when it reaches a point corresponding to its bottom dead centre;

a second arc-shaped path section for dosing where the piston is initially at the bottom dead centre, in such manner as to collect as much product as possible in the head, and moves in a radial direction towards the outside of the revolving drum until it reaches the endpoint of the feed station where there is a wall for levelling off the product accommodated in the impression;

a third arc-shaped path section for tamping the disc, where the piston moves radially towards the outside of the revolving drum and against a stop wall corresponding to its top dead centre where it remains until it starts on a fourth arc-shaped path section where the piston moves back up in order to facilitate detachment of the disc from the impression just before reaching the point where the disc is released.

9. The device according to claim 7, wherein the guide cam profile is divided into two arc-shaped sectors, a fixed lower section and an adjustable upper section, the adjustable upper section corresponding to a part of the path of the pistons comprising at least one area where the product is filled into the pistons.

10. A device for dosing and forming disks for pods containing a product for infusion; the pods being of the type comprising a piece of filter material containing a dose of the product for infusion in the form of a disk, wherein the device comprises at least the following:

a station for feeding the infusion product;

a revolving drum equipped with a plurality of pistons arranged radially on a peripheral surface of the revolving drum and designed to form a disk of the infusion product and to release the disk in the filter material, each piston being slidably mounted on the revolving drum for sliding along a respective axis and having a hollow head forming an impression designed to receive a dose of the infusion product fed by the feed station; wherein there is an arc-shaped wall round the outer surface of the revolving drum, said arc-shaped wall defining a tamping surface opposite to the impression of the pistons in a part of the circular path; and a fixed ring gear;

wherein each piston is movable along the respective axis towards said arc-shaped wall for compressing the infusion product included into the impressions against said tamping surface, and wherein the fixed ring gear is mounted inside the revolving drum and meshed with corresponding gear wheels keyed to the respective cylinder of each piston so that the pistons revolve continuously as the gear wheels directly engage the fixed ring gear while the pistons move round the circular path due to revolution of the drum, thus tamping the disk and preventing it from sticking inside the head of the piston while enabling the disk to be detached completely when it is deposited on the filter material.

11. A device for dosing and forming disks for pods containing a product for infusion; the pods being of the type comprising a piece of filter material containing a dose of the product for infusion in the form of a disk, wherein the device comprises at least the following:

a station for feeding the infusion product;

a revolving drum equipped with a plurality of pistons arranged radially on a peripheral surface of the revolving drum and designed to form a disk of the infusion product and to release the disk in the filter material, each piston being able to slide along a respective axis and having a hollow head forming an impression designed to receive a dose of the infusion product fed by the feed station;

wherein each piston is rotatably mounted on the revolving drum for continuously rotating about said respective axis;

wherein rotational drive means, acting on each piston, are located on the drum and comprises a fixed ring gear mounted inside the drum and directly meshed with corresponding gear wheels keyed to a respective cylinder of each piston so that the pistons revolve continuously as they move round the circular path due to revolution of the drum.

* * * * *